United States Patent [19]

Evans

[11] 3,984,102

[45] Oct. 5, 1976

[54] FLUID TYPE EXERCISING EQUIPMENT

[76] Inventor: Harold Ronald Evans, Bon Ami, Rue Des Cotils, Fauvic, Jersey, Guernsey (Channel Is.)

[22] Filed: Apr. 30, 1975

[21] Appl. No.: 573,255

[30] Foreign Application Priority Data

May 7, 1974 United Kingdom ..... 19944/74

[52] U.S. Cl. ..... 272/130

[51] Int. Cl.[2] ..... A63B 21/00

[58] Field of Search ..... 272/79 C, 80, 81, 57 R, 272/DIG. 1, 130

[56] References Cited

UNITED STATES PATENTS

| | | | |
|---|---|---|---|
| 3,587,319 | 6/1971 | Andrews | 272/79 C X |
| 3,640,528 | 2/1972 | Proctor | 272/81 |
| 3,717,342 | 2/1973 | Haney et al. | 272/79 C X |
| 3,861,675 | 1/1975 | Hopper | 272/80 X |

FOREIGN PATENTS OR APPLICATIONS

| | | | |
|---|---|---|---|
| 650,009 | 2/1951 | United Kingdom | 272/79 C |

*Primary Examiner*—Richard C. Pinkham
*Assistant Examiner*—William R. Browne
*Attorney, Agent, or Firm*—Holman & Stern

[57] ABSTRACT

Exercising equipment having a base, a water receivable tube upstanding from the base and a body incorporating a valve member, the body is suspended in water in the tube and is pulled upwardly by a person exercising, the valve member acts to apply a restraining force against upward movement of the body but permits downward movement of the body by a gravitational force on the body.

8 Claims, 2 Drawing Figures

FLUID TYPE EXERCISING EQUIPMENT

FIELD OF THE INVENTION

This invention relates to exercising equipment and has as its object the provision of such equipment in a convenient form.

SUMMARY OF THE INVENTION

In accordance with the present invention there is provided exercising equipment comprising a base, water or other liquid receivable in a tube upstanding from and secured to said base, a body incorporating a valve member and means whereby, in use, the body can be suspended in liquid within said tube and pulled upwardly towards that end of the tube remote from said base by a person exercising, said valve member acting, in use, to apply a restraining force against upward movement of said body but permitting downward movement of said body by gravitational forces on said body.

Preferably, said equipment includes an arm carried by the upper end of said tube and extending transversely to the axis of said tube, said means being in the form of a flexible elongated element connected in use to said body and extending over at least one pulley wheel supported by said arm.

Conveniently, said arm extends across the interior of the upper end of said tube and projects outwardly from said tube at opposite ends in a direction perpendicular to the axis of said tube, said arm carrying two inner pulley wheels mounted within the confines of said tube and an outer pulley wheel adjacent each outer end of the arm, said flexible elongated element extending over all four wheels and being looped downwardly at a position intermediate said two inner pulley wheels, the looped portion carrying a further pulley wheel, which is connected in use to said body.

Desirably, said body is in the form of an open ended tubular element having a stem secured coaxially thereto for slidably supporting an apertured valve member which in use, when said body is lifted upwardly, seats against the said tubular element so as to allow water to pass only through the apertures in it, thereby applying said restraining force, but which upon downward movement of said tubular element slides along said stem out of contact with the tubular element thus permitting unrestrained downward movement thereof.

Alternatively, said body is in the form of an open ended tubular element having a pair of segmental Leaf-like valve members pivotably connected to the upper end of said element for movement, in use between a first position, in which they close the in use upper end of said element, and to which position they are resiliently biased and a second position, to which they pivot about an axis parallel to a diameter of the element upon downward movement of the element, to open the upper end of said element, thereby permitting unrestrained downward movement thereof; there being further provided at least one aperture in at least one of the valve members, or defined between the valve members, so as to permit the passage of water, in use, therethrough during upward restrained movement of the body.

Conveniently, opposite free ends of said flexible elongated element have hand grips connected thereto.

Conveniently, three additional pulleys are provided together with an endless length of flexible elongated material extending over each additional pulley, two of the latter being connectible to a pair of remote positions of said base and the third pulley being connectible to said means, so that, in use the exerciser may exercise parts of his body by exerting a force on the portion of said continuous length of material intermediate the two pulleys connectible to said base.

Moreover, if desired, a pad may be connected to said portion of said continuous length of material.

A back rest may be carried by said tube.

BRIEF DESCRIPTION OF THE DRAWING

The invention will now be more particularly described with reference to the accompanying drawings wherein.

DESCRIPTION OF PREFERRED EMBODIMENTS

Figure 1:
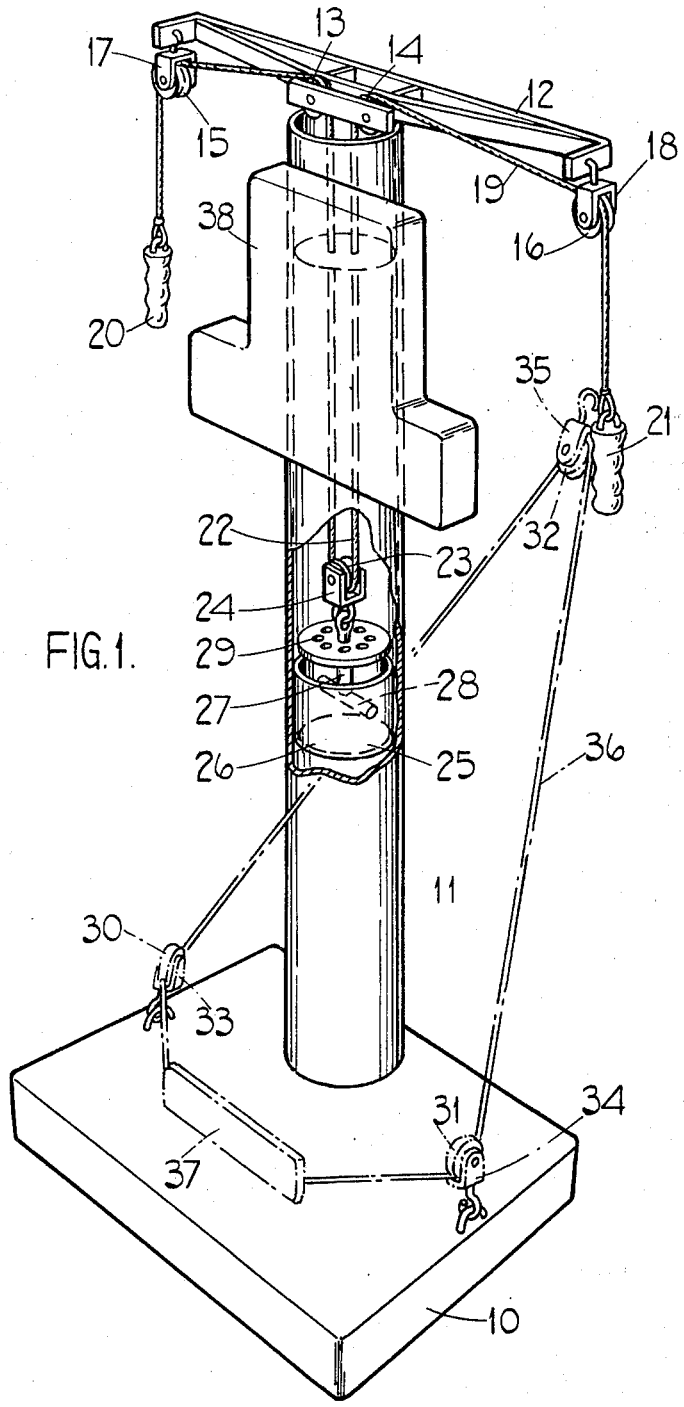
FIG. 1 is a perspective, partly broken away, view of one embodiment of equipment constructed in accordance with the present invention.

Referring now more particularly to the accompanying drawings, the exercising equipment shown therein comprises a base 10 which is rectangular in plan and a water or other liquid receiving tube 11 upstanding from and secured to the base 10 in a central rear region thereof. An arm 12 is carried by the upper end of the tube 11, extends across the interior of the tube and projects outwardly from the tube at opposite ends in a direction perpendicular to the axis of the tube. The arm carries two inner pulley wheels 13 and 14 mounted on axes which are secured to the arm 12 within the confines of the tube, and a pair of outer pulley wheels 15 and 16 mounted on axes which are secured to bridges 17 and 18 respectively, releasably suspended from opposite outer ends of the arm. A flexible elongated element in the form of a length of wire or string 19 extends over all four pulley wheels and has hand grips 20 and 21 releasably attached to opposite free ends. The length of wire or string 19 is looped downwardly at a position intermediate the pulley wheels 13 and 14, the looped portion (indicated by the reference numeral 22) carrying a further pulley wheel 23, the axis of which is secured to a bridge 24 which is in turn releasably attached to a body 25. The upper end of the tube 11 may have fitted thereto a cap (not shown).

The body 25 which, as shown, is a non-sealing fit inside the tube 11, comprises an open ended tubular element 26 having a stem 27 (connected to bridge 24) secured coaxially thereto by a part 28 which is secured to and diametrically traverses the interior of the tubular element 26. The stem projects outwardly from the upper end of the tubular element and is releasably attached to the bridge 24. An apertured valve member 29 slidably supported on the outwardly projecting portion of the stem 27 so that, in use, an exerciser pulls on one or both of the hand grips 20, 21, thereby causing the body 25 to lift, the valve member 29 seats against the in use upper axial end of the tubular element 26 so that water can only pass through the apertures in the valve member and this applies a restraining force against upward movement of the body 25. However, when the exerciser releases the hand grip(s) the body 25 will fall readily under the influence of gravity as the valve member 29 moves on the stem 27 out of contact with the tubular element 26.

Three additional pulley wheels 30, 31 and 32, having respective bridges 33, 34 and 35 supporting their axes, are also provided. The bridges 33 and 34 are releasably connected to opposite sides of the base 10 and the bridge 35 is releasably connected to one end of the length of wire or string 19. An endless length of wire or string 36 extends over all three pulley wheels 30, 31 and 32 and a pad 37 is connected to that portion of the wire or string 36 intermediate the pulley wheels 30 and 31. This feature enables the exerciser to exercise, inter alia, his foot and leg muscles by hooking those parts of his body around the pad 37 and exerting the necessary force to lift the body 25.

A back rest 38 is connected to the tube 11 so that an exerciser may lean against it if desired.

Figure 2:
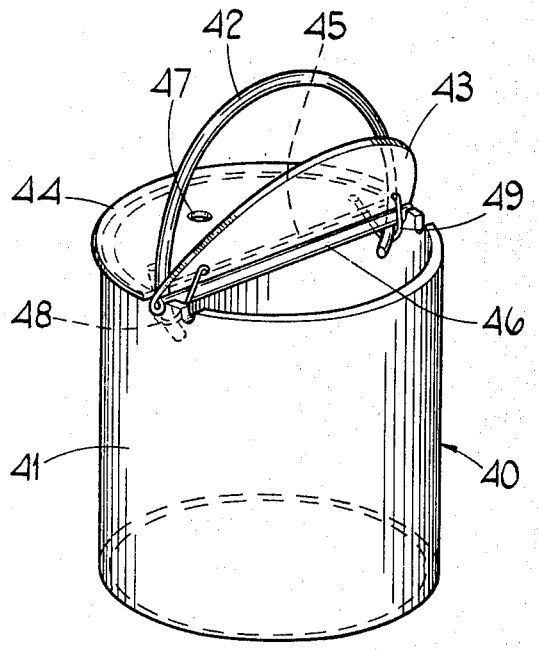
FIG. 2 is an enlarged perspective view showing a modification to the valve shown in FIG. 1.

Referring now to FIG. 2, there is shown therein a modified form of the valve member body hereinbefore designated reference number 25. The modified body is designated by reference number 40 and comprises an open ended tubular element 41 having an arcuate arm 42 which is connected at a position adjacent its opposite free ends to inner but upper diametrically opposed portions of the element 41. The body 40 also comprises a pair of substantially semi-circular leaf-like valve members 43 and 44 each pivoted about their inner edges 45 and 46 which lie parallel to a diaameter of the element 41 and which are disposed on opposite sides of the arm 42. At least one of the members 43, 44 is pivoted about downturned flanges in one of at least two pairs of slots which are formed in the upper edge of the element 41 and which permit the spacing between adjacent parallel edges of the members 43 and 44 to be altered thereby adjusting the aperture defined therebetween and thus the restraining force applied to the body 40 as it undergoes upward movement. If desired, an aperture 47 may be formed in one or both members 43, 44. The two members 43 and 44 are resiliently connected together by two strips of elongated resilient material 48 and 49 which are respectively looped under inturned ends of the arm 42, the strips 48 and 49 resiliently urge the two members 43 and 44 to a position in which they substantially close the upper end of the element 41 during restrained upward movement of the body. However, when the body falls downwardly under the influence of gravity, the members 43 and 44 pivot upwardly against the resilient bias because of the pressure exerted by the water in the tube 11, thus allowing unrestrained downward movement of the body.

I claim:

1. Exercising equipment comprising a base; a liquid-receivable tube for normally containing, in use, a liquid, upstanding from and secured to said base; a body incorporating a valve member; an arm carried by the upper end of said tube and extending transversely across said upper end of said tube and perpendicular to the longitudinal axis of said tube so as to project outwardly from said tube at opposite ends; two inner guide members disposed within a longitudinal projected cross section of the tube and mounted adjacent to said tube; an outer guide member mounted adjacent to each outer end of said arm and carried by said arm; and a flexible elongated element which extends over the aforesaid four guide members and which is looped downwardly at a position intermediate the two inner guide members, the looped portion carrying said body such that, in use, said body is suspended in liquid within said tube and can be pulled upwardly towards that end of the tube remote from said base by a person exercising, said valve member serving, in use, to apply a restraining force against upward movement of said body but permitting downward movement of said body by gravitational forces on the body.

2. Exercising equipment as claimed in claim 1, wherein opposite free ends of said flexible elongated element have hand grips connected thereto.

3. Exercising equipment as claimed in claim 1 wherein said body is in the form of an open ended tubular element having a stem secured coaxially thereto for slidably supporting an aperture valve member which in use, when said body is lifted upwardly, seats against said tubular element so as to allow water to pass through only the apertures in it, thereby applying said restraining force, but which upon downward movement of said tubular element slides along said stem out of contact with the tubular element thus permitting unrestrained downward movement thereof.

4. Exercising equipment as claimed in claim 1 wherein said body is in the form of an open ended tubular element having a pair of segmental leaf-like valve members pivotably connected to the in use upper end of said element for movement between a first position in which they close the in use upper end of said element and to which position they are resiliently biassed and a second position to which they pivot about an axis parallel to a diameter of the element upon downward movement of the element to open the upper end of said element thereby permitting unrestrained downward movement thereof, there being further provided at least one aperture in at least one of the valve members or defined between the valve members so as to permit the passage of water in use therethrough during upward restrained movement of the body.

5. Exercising equipment as claimed in claim 1 wherein three additional guide members are provided together with a continuous length of flexible elongated material extending over each additional guide member, two of the latter being connectible to a pair of remote portions of said base and the third quide member being connectible to said means so that in use the exerciser may exercise parts of his body by exerting a force on the portion of said continuous length of material intermediate the two guide members connectible to said base.

6. Exercising equipment as claimed in claim 5 wherein a pad is connected to said portion of the continuous length of material.

7. Exercising equipment as claimed in claim 1 wherein a back rest is carried by said tube.

8. Exercising equipment as claimed in claim 1 in which said guide members comprises pulley wheels.

* * * * *